US006501444B1

(12) United States Patent
Yanagida et al.

(10) Patent No.: US 6,501,444 B1
(45) Date of Patent: Dec. 31, 2002

(54) PLASMA DISPLAY PANEL CAPABLE OF BEING EASILY DRIVEN AND DEFINITELY DISPLAYING PICTURE

(75) Inventors: Kazuaki Yanagida, Tokyo (JP); Masayuki Noborio, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/170,721

(22) Filed: Oct. 14, 1998

(30) Foreign Application Priority Data

Oct. 14, 1997 (JP) ..... 9-280003

(51) Int. Cl.[7] ..... G09G 3/28

(52) U.S. Cl. ..... 345/60; 345/61; 345/62; 345/63; 345/64; 345/55; 345/72; 345/74; 315/169.1; 315/169.2; 315/169.4; 313/484; 313/485; 313/487; 313/584

(58) Field of Search ..... 345/60, 61, 62, 345/63, 74, 55, 64, 72; 315/169.4, 169.1, 169.2; 313/484, 485, 487, 584

(56) References Cited

U.S. PATENT DOCUMENTS

| | | | | | |
|---|---|---|---|---|---|
| 4,233,623 | A | * | 11/1980 | Pavliscak | 358/59 |
| 4,833,463 | A | * | 5/1989 | Dick et al. | 315/169.4 |
| 5,789,862 | A | * | 8/1998 | Makino | 313/584 |
| 5,793,158 | A | * | 8/1998 | Wedding, Sr. | 313/493 |
| 5,828,356 | A | * | 10/1998 | Stoller | 345/60 |
| 5,912,652 | A | * | 6/1999 | Seo | 345/60 |
| 5,940,163 | A | * | 8/1999 | Byrum | 345/74 |
| 5,952,036 | A | * | 9/1999 | Tadaki et al. | 427/64 |
| 5,966,107 | A | * | 10/1999 | Amemiya | 345/60 |
| 6,022,652 | A | * | 2/2000 | Haven et al. | 430/26 |
| 6,075,504 | A | * | 6/2000 | Stoller | 345/60 |
| 6,088,010 | A | * | 7/2000 | Makino et al. | 345/60 |
| 6,097,357 | A | * | 7/2000 | Shinoda et al. | 345/63 |
| 6,195,070 | B1 | * | 2/2001 | Shinoda et al. | 345/60 |

FOREIGN PATENT DOCUMENTS

| | | |
|---|---|---|
| JP | 53-53960 | 5/1978 |
| JP | 3-78936 | 4/1991 |
| JP | 5-119737 | 5/1993 |
| JP | 7-288085 | 10/1995 |
| JP | 8-101665 | 4/1996 |
| JP | 8-297480 | 11/1996 |

* cited by examiner

*Primary Examiner*—Richard Hjerpe
*Assistant Examiner*—Ali Zamani
(74) *Attorney, Agent, or Firm*—Sughrue Mion, PLLC

(57) ABSTRACT

In a plasma display panel, red, green, and blue pixels have the same voltage range for write discharges. The red, the green, and the blue pixels have first, second, and third data electrodes, respectively, covered with an insulating film. A red fluorescent substance layer is formed on the insulating film over the first data electrode. A green fluorescent substance layer is formed on the insulating film over the second data electrode. A blue fluorescent substance layer is formed on the insulating film over the third data electrode. The green fluorescent substance is smaller than both of the red and the blue fluorescent substance layers in thickness.

20 Claims, 11 Drawing Sheets

| PITCH OF PIXELS | WIDTH OF DATA ELECTRODE IN GREEN PIXEL | WIDTH OF DATA ELECTRODE IN RED AND BLUE PIXELS |
|---|---|---|
| 1.05 mm | 120 ~ 140 μm | 90 ~ 110 μm |
| 0.8 mm | 90 ~ 110 μm | 70 ~ 90 μm |
| 0.5 mm | 55 ~ 75 μm | 30 ~ 50 μm |
| 0.3 mm | 30 ~ 50 μm | 20 ~ 40 μm |

FIG. 15

PLASMA DISPLAY PANEL CAPABLE OF BEING EASILY DRIVEN AND DEFINITELY DISPLAYING PICTURE

BACKGROUND OF THE INVENTION

This invention relates to a plasma display panel, particularly, relates to a plasma display panel which can be easily driven and definitely display a picture.

A plasma display panel (PDP) is known as a flat display panel that it is easy to enlarge a display area. The plasma display panel is used for a wall television set or a display unit of a computer system, such as a personal computer, a workstation, and so on.

The plasma display panel has a plurality of pixels (i.e. emission or discharge cells) which are arranged in a plane and classified into red (R), green (G), and blue (B) pixels. Each of the red pixels has a red fluorescent substance layer. Similarly, each of the green and the blue pixels has a green and a blue fluorescent substance layers, respectively. The red, the green, and the blue fluorescent substance layers are different from one another in electrification characteristics and capacitance. Therefore, it is difficult to carry out uniformly write operations in the red, the green, and the blue pixels.

SUMMARY OF THE INVENTION

It is therefore an object of this invention to provide a plasma display panel which can be easily driven.

It is another object of this invention to provide a plasma display panel has enough luminance to improve its definition.

It is still another object of this invention to provide a plasma display panel that it is easy to enlarge a display area.

Other object of this invention will become clear as the description proceeds.

According to the gist of this invention, a plasma display panel comprising red, green, and blue pixels which include data electrodes covered with an insulating layer and which have voltage ranges for write discharges caused by the use of the data electrodes. A write voltage equalizing structure is formed in at least one of the red, the green, and the blue pixels for equalizing the voltage ranges with one another.

According to another gist of this invention, a plasma display panel comprises a front substrate with a first surface. A back substrate has a second surface which is opposite to the first surface at a distance. A scanning electrode is formed on the first surface along a first direction. First, second, and third data electrodes formed on the second surface along a second direction perpendicular to the first direction and are used for write discharges together with the scanning electrode. An insulating layer is formed on the first, the second, and the third data electrodes and exposed areas of the second surface. A red fluorescent substance layer is formed on the insulating layer over the first data electrode. A green fluorescent substance layer is formed on the insulating layer over the second data electrode. A blue fluorescent substance layer is formed on the insulating layer over the third data electrode. A write voltage equalizing structure is formed between the front substrate and the back substrate for equalizing voltage ranges of proper voltage which cause the write discharges between the scanning electrode and all of the first, the second, and the third data electrodes.

BRIEF DESCRIPTION OF THE DRAWING

FIG. 15 is a table showing a relation between pitch of pixels and width of data electrodes;

DESCRIPTION OF THE PREFERRED EMBODIMENTS

Referring to FIGS. 1 through 7, description will be at first directed to a conventional AC (alternating current) driven type plasma display panel for a better understanding of this invention. Though the plasma display panel has a large number of pixels which are arranged in a plane, the description will be made about a picture unit that includes three (i.e. red, green, and blue) pixels.

Figure 1:
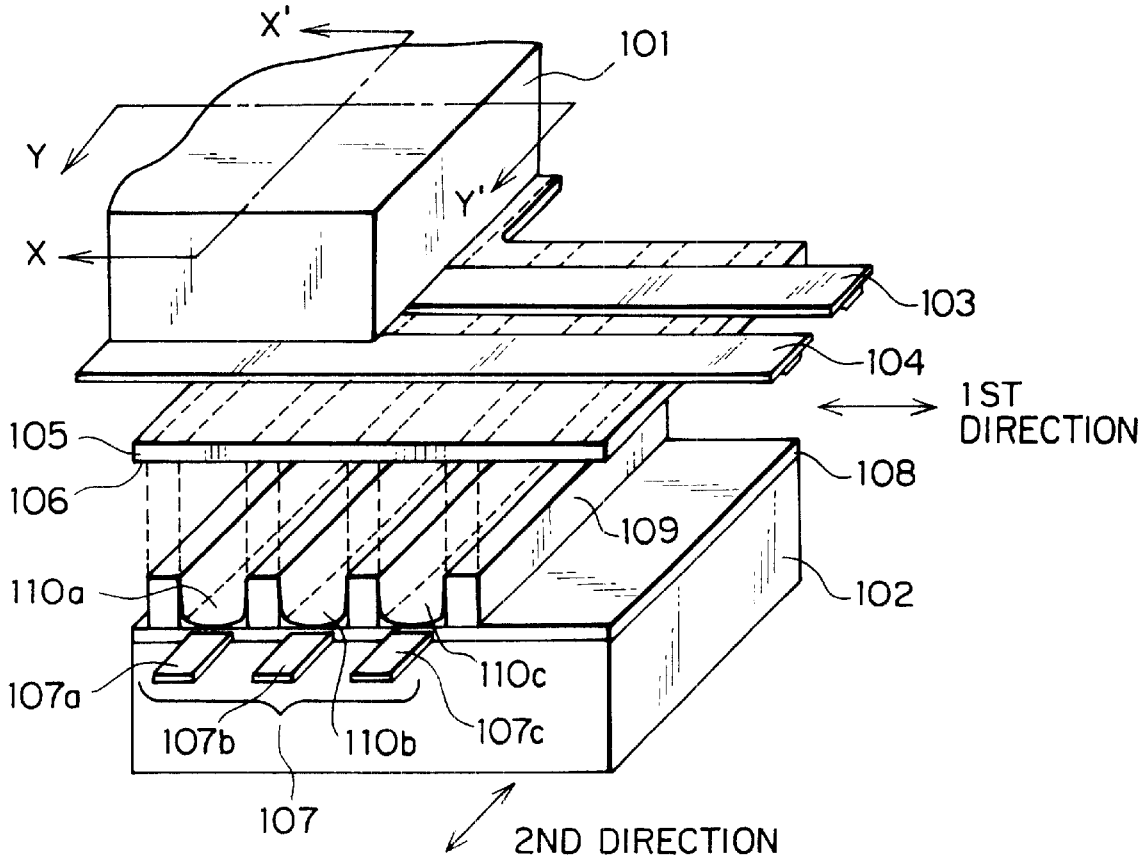
FIG. 1 PRIOR ART
FIG. 1 shows a structure of a conventional plasma display panel.

In FIG. 1, the plasma display panel comprises a front substrate 101 which has a first surface. A back substrate 102 has a second surface which is opposite to the first surface at a distance. Scanning electrode 103 and common electrode 104 are formed on the first surface along a first direction at a distance. The scanning electrode 103 and the common electrode 104 forms a surface discharge electrode pair. A first insulating layer 105 is formed on the scanning electrode 103, the common electrode 104 and exposed areas of the first surface. A protective layer 106, e.g. a magnesium oxide (MgO) film, is formed on the first insulating layer 105 to protect the first insulating layer 105 from discharges, which will be described later.

First, second, and third data electrodes 107*a*, 107*b*, and 107*c* are formed on the second surface at regular intervals and along a second direction which is at right angles to the first direction. A second insulating layer (or a glaze layer) 108 is formed on the first, the second, and the third data electrodes 107*a*, 107*b*, and 107*c* and exposed areas of the second surface. Partitions 109 are formed on the second insulating layer 108 at the regular intervals along the second direction to secure discharge spaces and to define the pixels. Red, green, and blue fluorescent substance layers 110*a*, 110*b*, and 110*c* are formed on exposed areas of the second insulating layer 108 over the data electrodes 107*a*, 107*b* and 107*c*, respectively. If necessary, the fluorescent substance layers 110*a*, 110*b*, and 110*c* are formed on side surfaces of the partitions 109. The red fluorescent substance layer 110 includes a red fluorescent substance, which changes ultraviolet rays generated by the discharge into visible red rays. Similarly, the green and the blue fluorescent substance layers 110*b* and 110*c* include green and blue fluorescent substances, which change ultraviolet rays into visible green and blue rays, respectively.

The protective layer 106 is glued to upper surfaces of the partitions 109 to define the discharge spaces. Namely, the protective layer 106, the fluorescent substance layers 110*a*, 110*b*, and 110*c*, and the partitions 109 define the discharge spaces. Discharge gas, such as helium (He), neon (Ne), xenon (Xe), and their mixed gas, is sealed into the discharge spaces and in contact with surfaces of the fluorescent substance layers 110*a*, 110*b*, and 110*c*.

Figure 2:
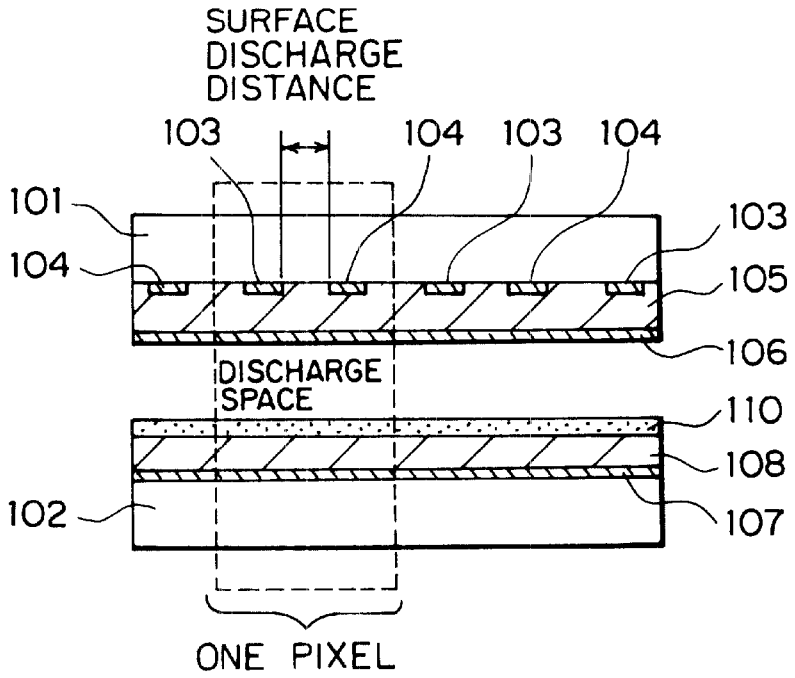
FIG. 2 PRIOR ART
FIG. 2 shows an X–X' line sectional view of FIG. 1.

FIG. 2 shows an X–X' line sectional view of FIG. 1. However, two complete pixels and two incomplete pixels are shown in FIG. 2. Namely, two pairs of the scanning and the common electrodes 103 and 104, a single scanning electrode 103, and a single common electrode 104 are shown in FIG. 2. The pixels are defined so that one pair of the scanning and the common electrodes 103 and 104 is included in each. In each pixel, the distance between the scanning electrode 103 and the common electrode 104 is called a surface discharge distance.

Figure 3:
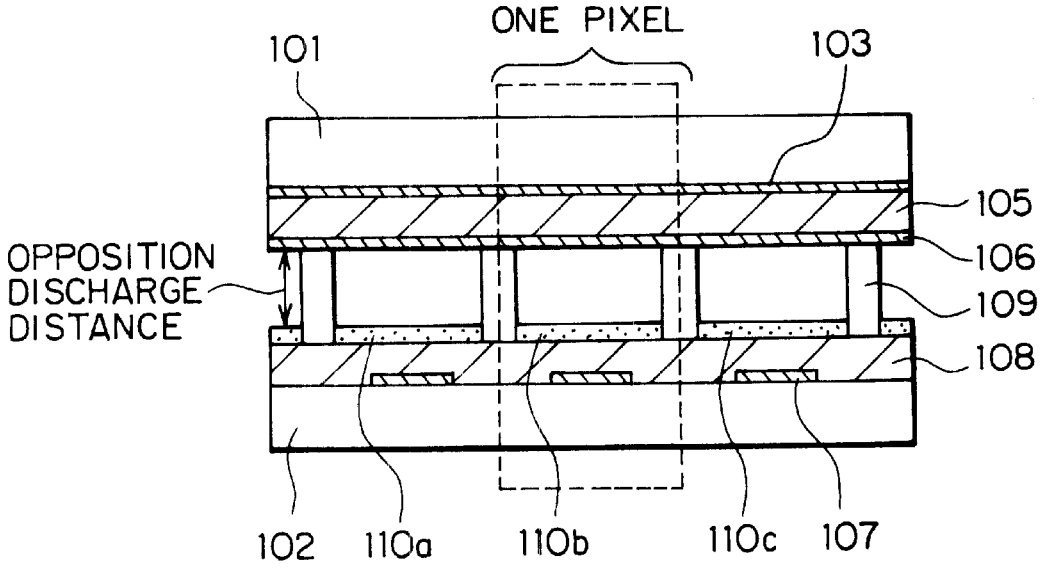
FIG. 3 PRIOR ART
FIG. 3 shows a Y–Y' line sectional view of FIG. 1.

FIG. 3 shows a Y–Y' line sectional view of FIG. 1. In FIG. 3, the partitions 109 define the pixels. A distance between the protective layer 106 and the fluorescent substance layer 110 is called an opposition discharge distance.

In this structure, each of the fluorescent substance layers 110*a*, 110*b*, and 110*c* extends over pixels and along each data electrode 107. This is because the fluorescent substance layers 110*a*, 110*b*, and 110*c* are formed by a screen printing method for easiness and preciseness.

Figure 4:
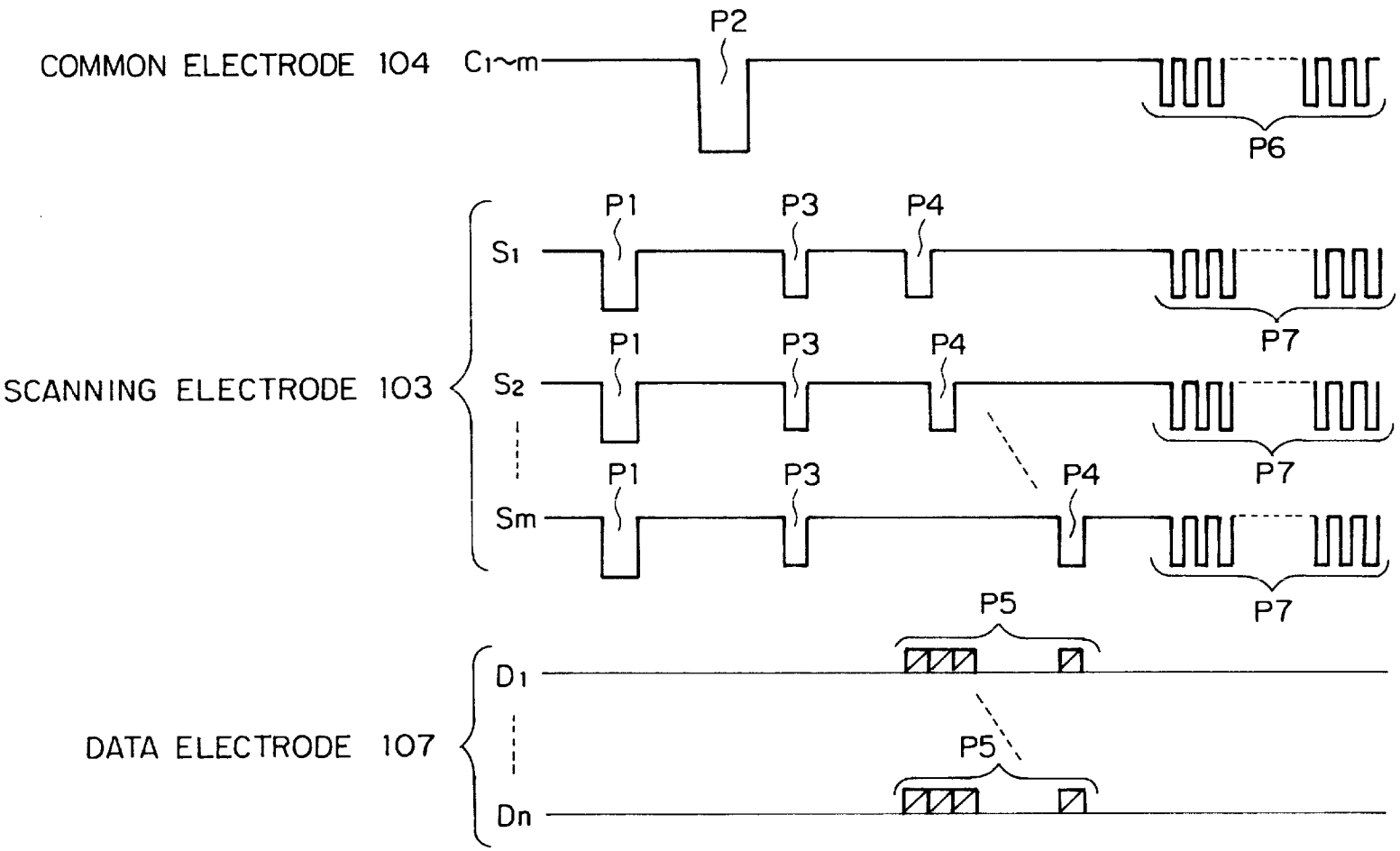
FIG. 4 PRIOR ART
FIG. 4 is a timing chart for use in describing an operation of the plasma display panel of FIG. 1.

Referring to FIG. 4 together with FIGS. 1 to 3, an operation of the plasma display panel will be mentioned soon. Now, it is assumed that the plasma display panel has m×n pixels. Namely, the plasma display panel has m (m: natural number) of the pairs of the scanning and the common electrodes 103 and 104 and n (n: natural number) of the data electrodes 107.

At first, all of the scanning electrodes 103 (S1–Sm) are supplied with erasing pulses P1 at the same time. In each of the pixels, the erasing pulse P1 causes erasing discharge. If the pixel is emitting light, the erasing discharge stops the pixel from emitting light. As a result, all of the pixels are in a non-discharge state.

Next, all of the common electrodes 104 (C1–Cm) are supplied with preliminary discharge pulses P2 to cause preliminary discharges between the scanning electrodes 103 and the common electrodes 104. Then, all of the scanning electrodes 103 (S1–Sm) are supplied with preliminary discharge erasing pulses P3 to finish the preliminary discharges.

In each pixel, the preliminary discharge makes the fluorescent substance layer 110 store electric charges at its surface. The amount of the electric charges are decided by electrification characteristics of the fluorescent substance and capacitance between the data electrode 107 and surface discharge electrode pair (i.e. the scanning electrodes 103 and the common electrodes 104). The electrification characteristics of usual fluorescent substances for the plasma display panel are shown in FIG. 5.

Figure 5:
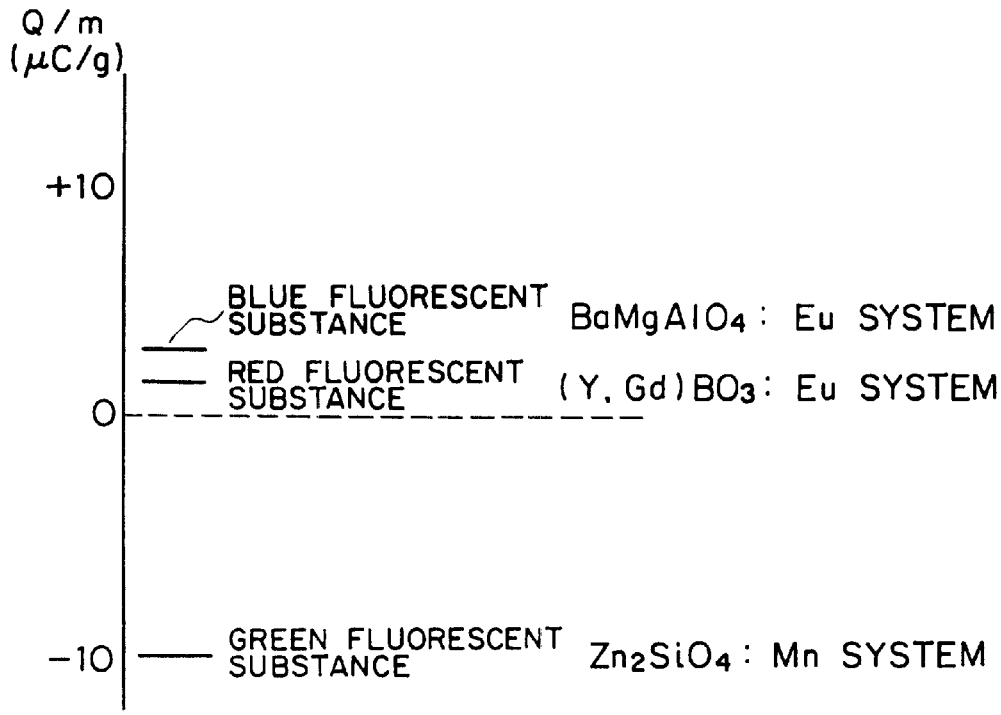
FIG. 5 PRIOR ART
FIG. 5 is a graph showing electrification characteristics of fluorescent substances for the plasma display panel of FIG. 1.

In FIG. 5, the vertical axis indicates the amount of the electric charges which can be stored in a gram of each fluorescent substance. The unit of the amount is electric charge (Q)/mass (m) (i.e. $\mu$C/g). Short segments in FIG. 5 shows results of measurement using blow-off method. As shown in FIG. 5, green fluorescent substance (i.e. a $Zn_2SiO_4$:Mn system) is more easily charged with negative charges than red and blue fluorescent substances (i.e. (Y, Gd)$BO_3$:Eu system and $BaMgAlO_4$:Eu system).

Returning to FIG. 4, after finishing the preliminary discharges, the scanning electrodes 103 (S1–Sm) are supplied with scanning pulses P4 in turn. In this event, the red, the green, and the blue pixels of each picture unit are supplied with one of the scanning pulses P4 at the same time. This is because the red, the green, and the blue pixels of each picture unit have one of the scanning electrodes 103 in common.

On the other hand, the data electrodes 107 (D1–Dn) are selectively supplied with the data pulses P5 which are synchronous with the scanning pulses P4. The data pulses P5 depend on emission data which decide emission or non-emission state of the pixels. Oblique lines in the data pulses P5 of FIG. 5 show dependence on the emission data.

In each pixel, if its scanning electrode 103 and its data electrode 107 are supplied with the scanning pulse P4 and the data pulses P5, respectively, then write discharge is caused between the scanning electrode 103 and the data electrode 107. On the other hand, if the scanning pulse P4 is supplied to its scanning electrode 103 and the data pulse P5 is not supplied to its data electrode 107, the write discharge is not caused between the scanning electrode 103 and the data electrode 107. The write discharge brings emission of light later. The write discharge is called an opposed discharge. In each picture unit, decisions of emission/non-emission states of the red, the green, and the blue pixels are carried out while the scanning pulse P4 is supplied to its scanning electrode 103.

In each pixel generating the write discharge, positive charges are stored in the first insulating layer 105 over its scanning electrode 103. The stored positive charges are called wall charges. In this situation, when its common electrode 104 is supplied with a sequence of first keeping pulses P6, the wall charges and the first pulse of the first keeping pulses P6 cause a first keeping sustaining discharge in each pixel generating the write discharge.

Then, each scanning electrode 103 is supplied with a sequence of second sustaining pulses P7 having polarities which are opposite to that of the first sustaining pulses P6. In each pixel generating the first sustaining discharge, the first sustaining pulses P6 and the second sustaining pulses P7 cause continuous sustaining discharges.

The first sustaining pulses P6 and the second sustaining pulses P7 are previously adjusted so that the sustaining discharges are not caused without the wall charges in each pixel. Thus, the first and the second sustaining pulses P6 and P7 in the pixel in which the write discharge is caused do not cause the sustaining discharges. Accordingly, the pixels selected by the scanning pulse P4 and the data pulses P5 emit light. Therefore, desired display pattern is displayed on the plasma display panel.

As mentioned above, the plasma display panel can display the desired display pattern. However, the red, the green, and the blue fluorescent substances are different from one another in the electrification characteristic and the capacitance. This means that the amount of the stored charges stored at the surface of each fluorescent substance layer before the write discharges is decided by the color of the fluorescent substance. Thus, condition (i.e. voltage between the scanning electrode 103 and the data electrode 107) for proper write discharge is decided by the color of the fluorescent substance.

Figure 6A:
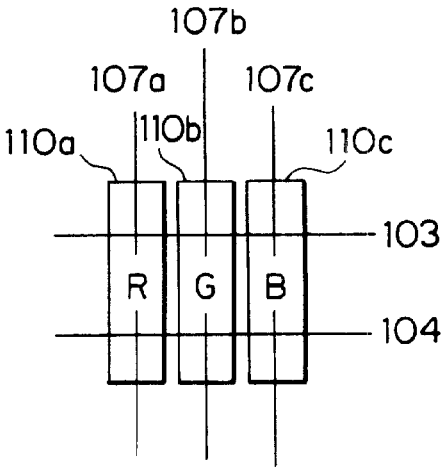
FIG. 6A PRIOR ART
FIG. 6A is a rough sketch of a picture unit for the plasma display panel of FIG. 1.

Now, the picture unit as shown in FIG. 6A is considered. The picture unit has the red (R), the green (G), and the blue (B) pixels that have the scanning electrode 103 and the common electrode 104 in common. Moreover, the red, the green, and the blue pixels have the data electrodes 107*a*, 107*b*, and 107*c*, respectively.

Figure 6B:
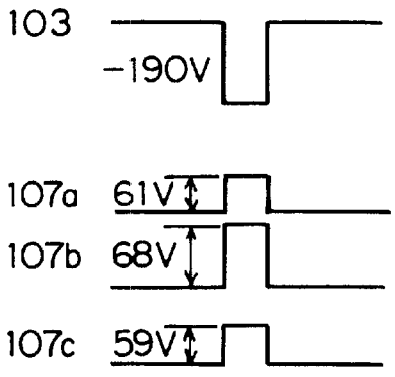
FIG. 6B PRIOR ART
FIG. 6B shows proper voltages supplied with data electrodes 107 of FIG. 6B to cause write discharges.
Figure 7:
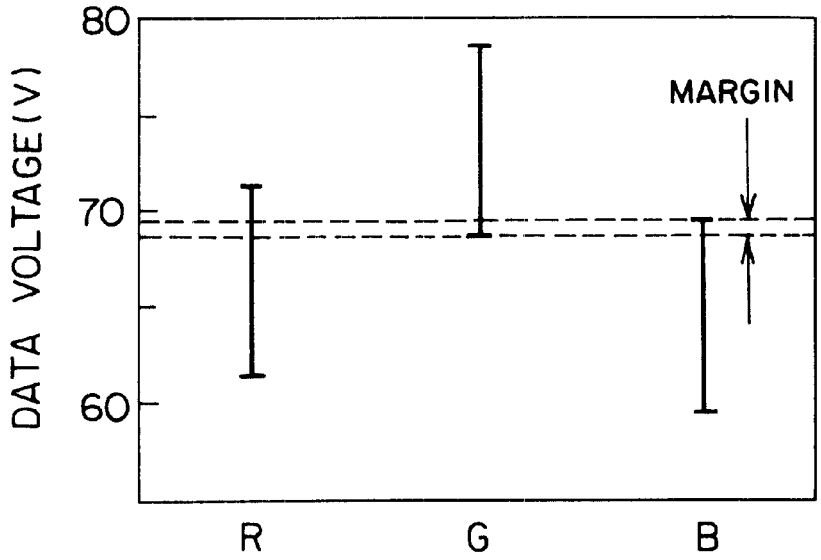
FIG. 7 PRIOR ART
FIG. 7 shows voltage ranges for the data electrodes 107 of FIG. 6B to cause the write discharges.

When the scanning pulse has a voltage of −190 volts, the data pulse must have a voltage over 61 volts for the red pixel as shown in FIG. 6B so as to cause the proper write discharge. Similarly, when the scanning pulse has the voltage of −190 volts, the data pulse must have a voltage over 68 volts for the green pixel as shown in FIG. 6B so as to cause the proper write discharge. Moreover, when the scanning pulse has the voltage of −190 volts, the data pulse must have a voltage over 59 volts for the blue pixel as shown in FIG. 6B so as to cause the proper write discharge. Namely, the lower limit of the data pulse is decided by each color of the pixel. Moreover, each of the data pulses must be limited under the upper limit that brings about an abnormal discharge. Thus, the data pulse has voltage range which is suitable for write discharge in each color of the pixel. The voltage ranges for the red, the green, and the blue pixels are shown in FIG. 7.

Generally, the data pulses are generated by a single data driver. Thus, in the conventional plasma display panel, the data pulses have the same voltage and the same pulse width regardless of the colors of the pixels. In other words, the red, the green, and the blue pixels are not distinguished from one another in the conventional plasma display panel. Therefore, the voltage of the data pulses must be decided so that the data pulses properly cause the write discharges in all pixels. Namely, the voltage of the data pulses is higher than all of the lower limits for the three color pixels and lower than all of the upper limits for the three color pixels. Therefore, the data pulses must have a voltage in a narrow range. This means that the margin for driving the data electrodes 107 is small and it is difficult to uniformly cause the write discharges in every pixel.

Figure 8:
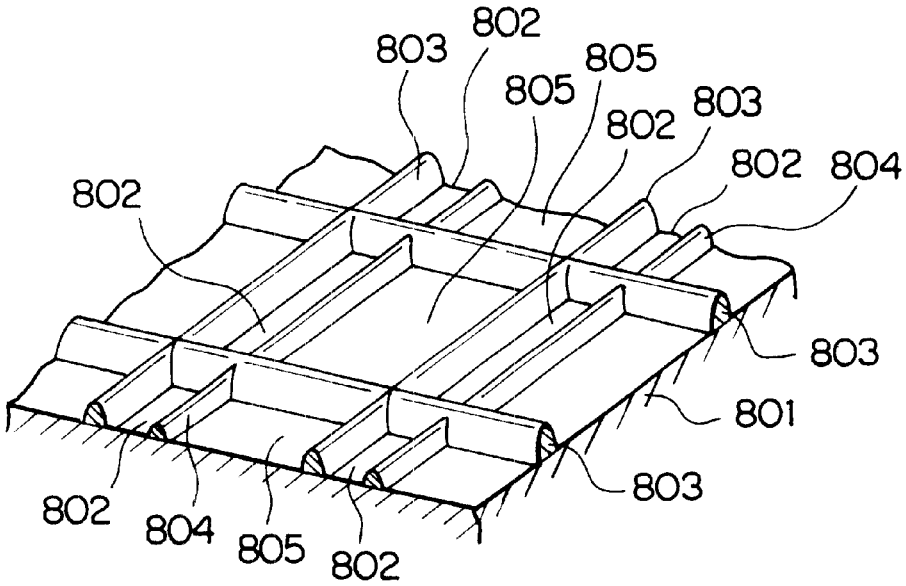
FIG. 8 PRIOR ART
FIG. 8 shows a structure of another conventional plasma display panel.

Referring to FIG. 8, another conventional plasma display panel will be described below.

The plasma display panel comprises a back substrate 801. Data electrodes 802 parallel to one another are formed on the back substrate 801. Lattice insulating ribs (or partitions) 803 are formed on the back substrate 801 to form discharge spaces for pixels. Additional insulating ribs 804 are formed along the data electrodes 802 on the back substrate 801. Fluorescent substance layers 805 are formed on exposed surfaces of the back substrate 801. Other elements for the plasma display panel are omitted in FIG. 8.

In this structure, the data electrodes 802 are exposed to the discharge spaces. As a result, discharges using the data electrodes 802 do not store electric charges in the fluorescent substance layers 805. This realizes stable operations of the plasma display panel. Such a plasma display panel is disclosed in Japanese Unexamined Patent Publication Tokkai Hei No. 3-78936.

However, each area of the fluorescent substance layers 805 are smaller than that of an ordinary plasma display panel because the data electrodes 802 are exposed to the discharge areas. Accordingly, the plasma display panel has faults that luminance is low for a high-definition television set and that it is difficult to improve definition.

Still another conventional plasma display panel is disclosed in Japanese Unexamined Patent Publication Tokkai Hei No. 8-297480. The plasma display panel can standardize chromaticity and luminance of red, green, and blue pixels.

However, the plasma display panel has a fault that it is difficult to drive it. This is because emitting time is individually controlled for each color pixel so that the red, the green, and the blue pixels have the same chromaticity and the same luminance.

Figure 9:
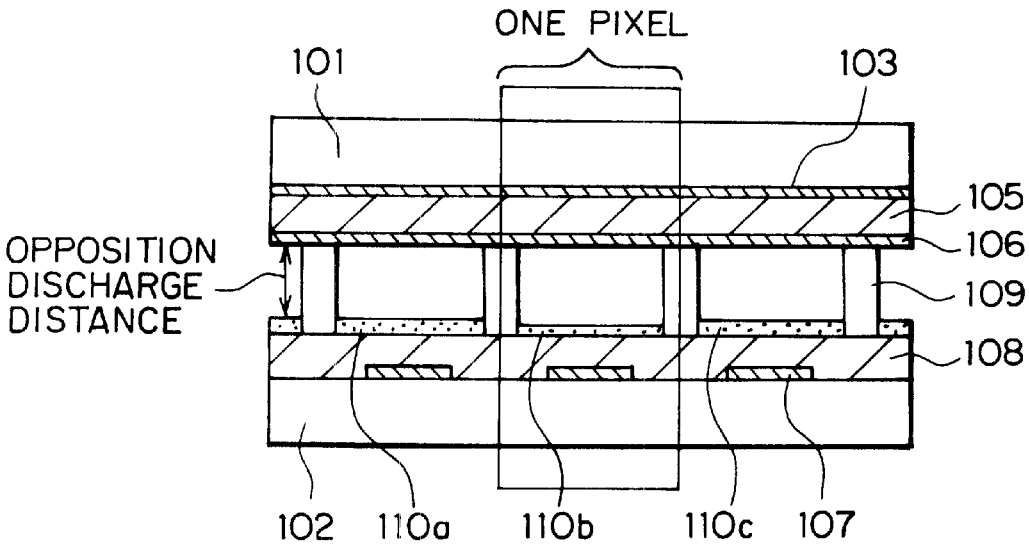
FIG. 9 is a partial sectional view of a plasma display panel according to a first embodiment of this invention.
Figure 10:
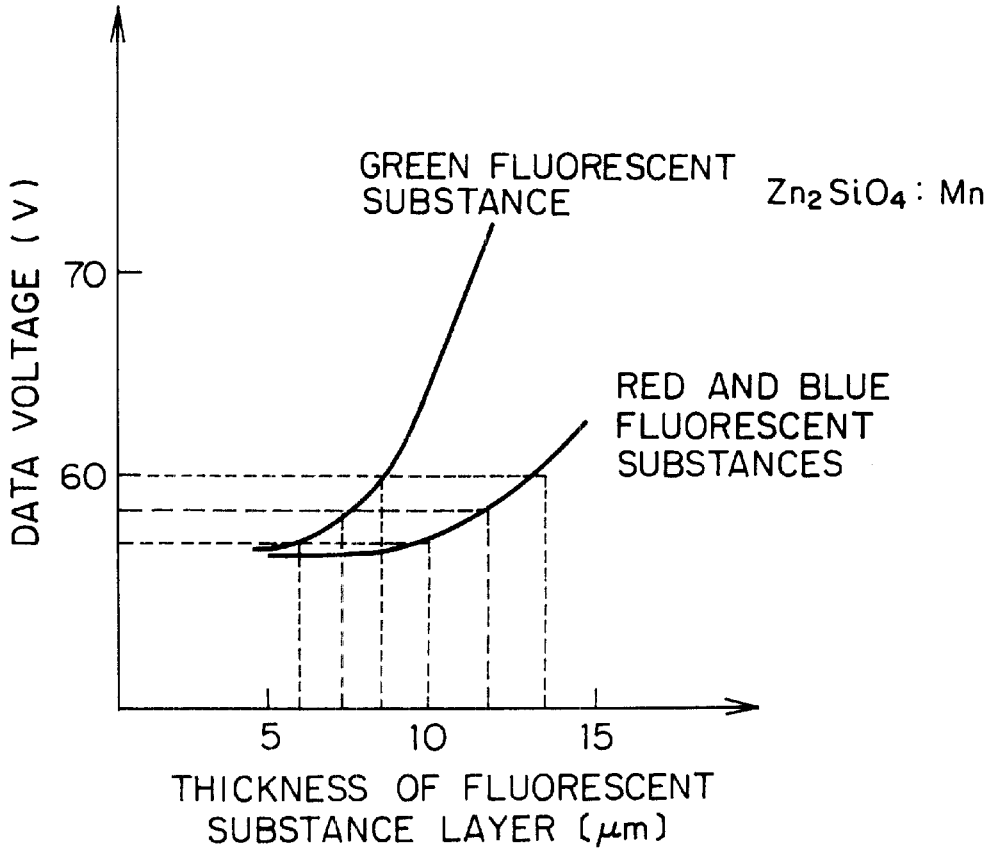
FIG. 10 is a graph showing a relation between thickness of fluorescent substance layers and data voltages for write discharges.

Referring to FIGS. 9 and 10, the description will proceed to a plasma display panel according to a first embodiment of this invention. Similar parts are designated by like reference numerals.

In FIG. 9, the plasma display panel has the green fluorescent substance layer 110*b* which is smaller than the red and the blue fluorescent substance layer 110*a* and 110*c* in thickness. The red and the blue fluorescent substance layer 110*a* and 110*c* may be equal in thickness. The plasma display panel is manufactured as mentioned below. It will be assumed that the pitch between two pixels which adjoin each other is 1.05 mm.

At first, a transparent film, such as an NESA ($SnO_2$:Sb) film or an ITO ($In_2O_3$:Sn) film, is formed on the first surface of the front substrate 101, which is glass. The transparent film is partially removed by using a photo etching method to leave stripes which extend to both sides of FIG. 9. The stripes are spaced at proper intervals. Each of the stripes has a width of about 275 $\mu$m. Metal electrodes (or trace electrodes: not shown) are generally formed on the stripes. Low resistance metal, such as silver, is used for the metal electrodes to substantially reduce resistance of the stripes. The stripes with the metal electrodes are used for the scanning electrodes 103 and the common electrodes 104.

Next, the first insulating layer 105 is formed on exposed area of the first surface, the scanning electrodes 103, and the common electrodes 104 by the use of a thick film printing process to cover the scanning electrodes 103 and the common electrodes 104. The first insulating layer 105 is, for example, a transparent glass layer. The protective layer 106 is formed on the first insulating layer 105 by a vacuum evaporation method to protect the first insulating layer 105 from the discharge. For example, the protective layer 106 is magnesium oxide film.

On the other hand, data electrodes 107 are formed on the second surfaces of the back substrate 102, which is glass. For example, the data electrodes 107 are formed by the thick film printing method using metal paste, such as silver paste. Each of the data electrodes 107 has about 130 $\mu$m in width and extends perpendicular to the sheet. The second insulating layer 108 is formed on the exposed area of the second surface and the data electrodes to cover the data electrodes 107. For example, the second insulating layer 108 is glass mixed with white pigment.

Next, the fluorescent substance layers 110 are formed on the second insulating layer 108 by the thick film printing process using red, green, and blue fluorescent substance paste. In this process, the green fluorescent substance paste has concentration which different from that of the red and the blue fluorescent substance paste. Thus, the green fluorescent substance layer 110*b* is smaller than both the red and the blue fluorescent substance layer 110*a* and 110*c* in thickness when the red, the green, and the blue fluorescent substance paste is dried. For example, the red, the green, and the blue fluorescent substance layer 110*a*, 110*b*, and 110*c* are 10–14 μm, 6–8 μm, and 10–14 μm, respectively, in thickness. The allowances of the thickness are necessary for unevenness in the single plasma display panel. The red fluorescent substance paste includes red fluorescent substance, such as a $(Y,Gd)BO_3$:Eu system, a $YVO_4$:Eu system, a $Y_2O_3$:Eu system, a $Y(PV)O_4$: system, $YBO_3$:Eu system, etc. The green fluorescent substance paste includes green fluorescent substance, such as a $Zn_2SiO_4$:Mn system, etc. The blue fluorescent substance paste includes blue fluorescent substance, such as a $BaMgAl_{10}O_{17}$:Eu system, a $CaWO_4$ system, a $BaMgAl_{14}O_{23}$:Eu system, $Y_2SiO5$ system, etc.

Then, the partitions 109 are formed on either the protective layer 106 or the second insulating layer 108 by the thick film printing process using a paste which includes powdered aluminum oxide and powdered glass. In addition, the partitions 109 are glued to the other. Each of the partitions 109 has a height that is decided so that a distance between the front substrate 101 and the back substrate 102 is 120–140 μm. Therefore, the discharge spaces are formed between the front substrate 101 and the back substrate 102. Gas, such as xenon (Xe), is sealed into the discharge spaces. The gas generates ultraviolet rays when the discharge occurs in each discharge space. In this way, AC driven type plasma display panel is completed.

In this structure, capacitance between the data electrodes 107 and the surface discharge electrode pairs are controlled by the thickness of the fluorescent substance layers 110*a*, 110*b*, and 110*c* and the amounts of electrification in the fluorescent substance layers are standardized. As a result, write voltage characteristics correspond to one another regardless of the colors of the pixels and the margin for the data voltage is increased. Therefore, it becomes easy to drive the AC driven type plasma display panel. In addition, the plasma display has enough luminance to improve its definition, because the data electrodes are exposed at discharge spaces.

Relation between the thickness of the fluorescent substance layers 110 and necessary data voltages for the write discharges are shown in FIG. 10. The red, the green, and the blue fluorescent substance are the $(Y,Gd)BO_3$:Eu system, the $Zn_2SiO_4$:Mn system, and the $BaMgAl_{10}O_{17}$:Eu system, respectively. The relations are effective even if other fluorescent substances are used for the red, the green, and the blue fluorescent substance layer.

In FIG. 10, when the thickness of the red and the blue fluorescent substance layers are 12 μm and when the thickness of the green fluorescent substance layer is 7 μm, the necessary data voltages corresponds to one another and is median of the proper data voltage range. Moreover, if the thickness of the red and the blue fluorescent substance layers are 10–14 μm and if the thickness of the green fluorescent substance layer is 6–8 μm, the necessary data voltage are within the proper range of ±3 volts. The thickness of the green fluorescent substance layer is about 0.4 (≈6/14)–0.8 (≈8/10) times of the thickness of the red or the blue fluorescent substance layer.

Figure 11:
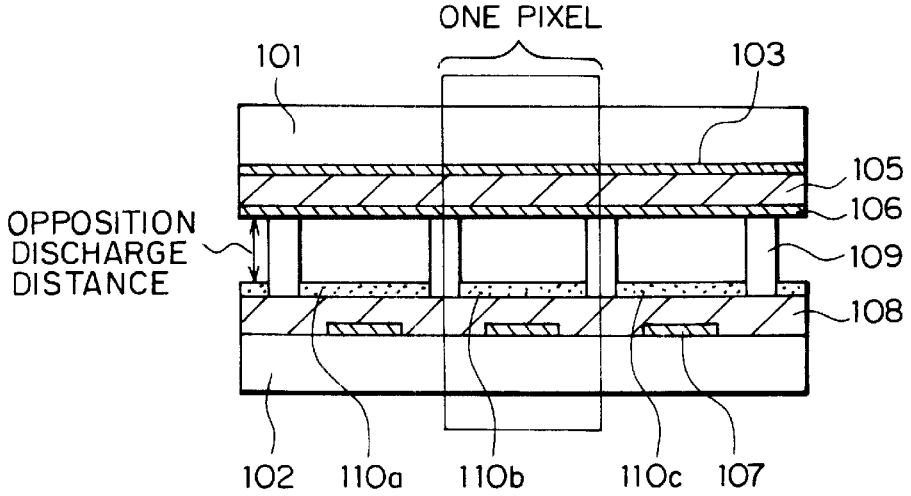
FIG. 11 is a partial sectional view of a plasma display panel according to a second embodiment of this invention.
Figure 12:
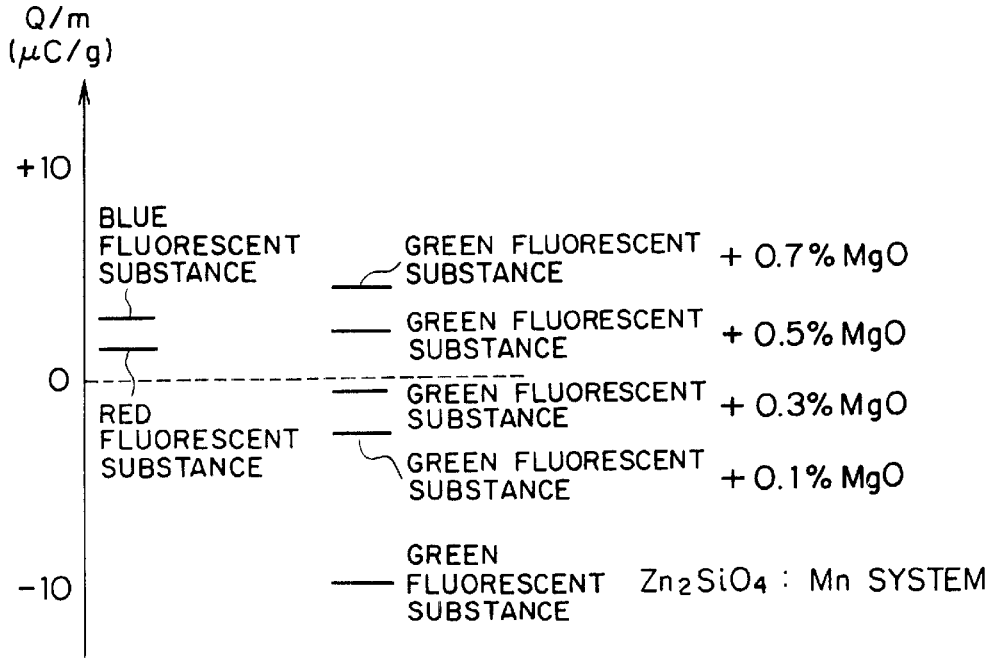
FIG. 12 is a graph showing a relation between electrification characteristics and magnesium oxide content.

Referring to FIGS. 11 and 12, the description will be made about a plasma display panel according to a second embodiment of this invention.

In FIG. 11, the plasma display panel has the same structure as the conventional plasma display panel except for the component of the green fluorescent substance layer 110*b*. The green fluorescent substance layer 110*b* includes a fluorescent substance which is the $Zn_2SiO_4$:Mn system and is covered with the magnesium oxide (MgO). The fluorescent substance is manufactured by baking of a mixture of the $Zn_2SiO_4$:Mn and the Mg(OH) (or $MGCO_3$). Electrification characteristics of some green fluorescent substances which differ from one another in the amount of the magnesium oxide are shown in FIG. 12.

As easily understood from FIG. 12, the electrification characteristics are approximate to those of the red and the blue fluorescent substances when the green fluorescent substances includes the magnesium oxide of 0.3–0.7 Wt % to the $Zn_2SiO_4$:Mn. Thus, the write voltage characteristics are standardized regardless of the colors and it becomes easy to drive the AC driven type plasma display panel.

Figure 13:
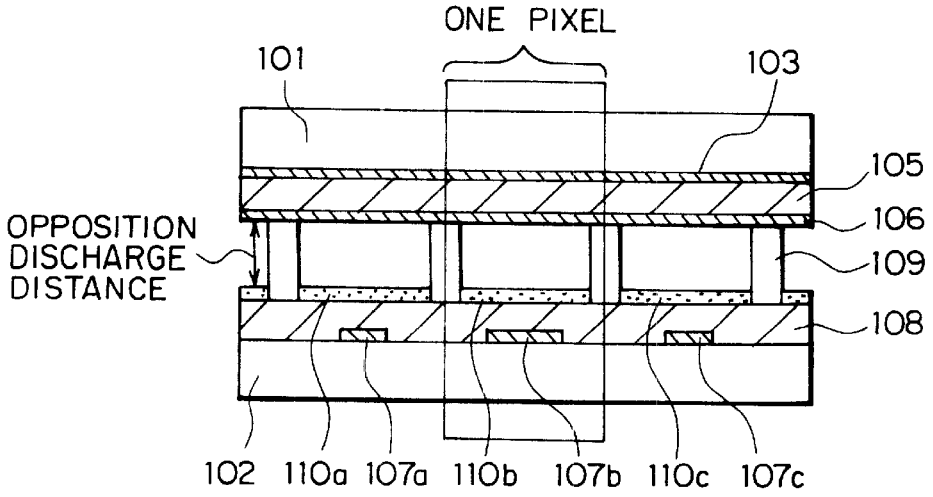
FIG. 13 is a partial sectional view of a plasma display panel according to a third embodiment of this invention.
Figure 14:
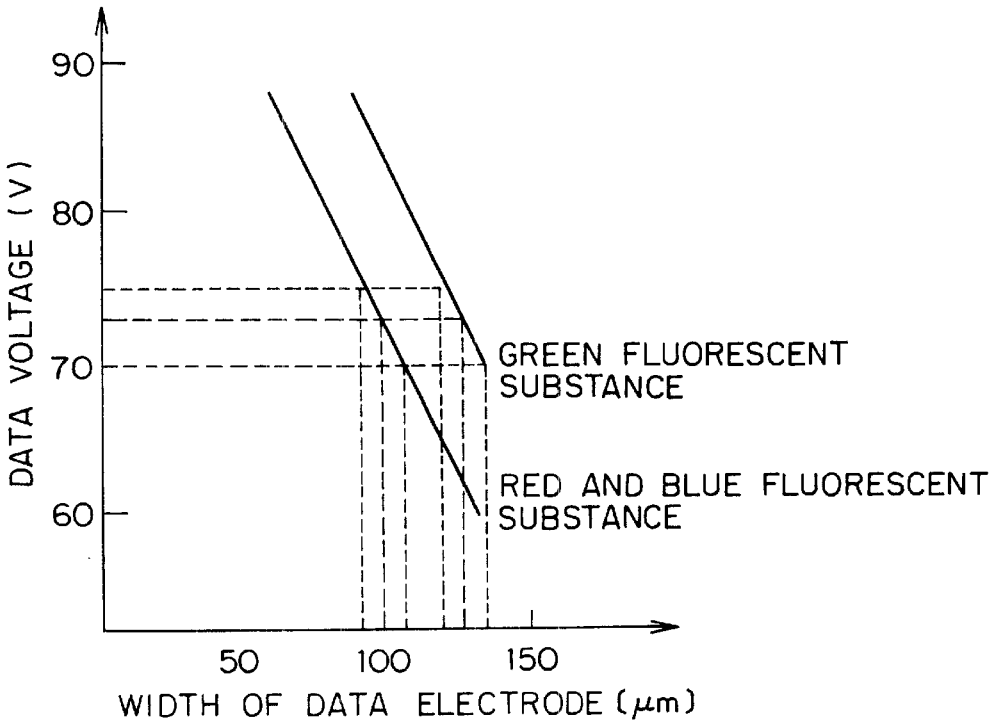
FIG. 14 is a graph showing a relation between width of data electrodes and data voltages for write discharges.

Referring to FIGS. 13 through 15, the description will be made about a plasma display panel according to a third embodiment of this invention.

In FIG. 13, the plasma display panel has the same structure as the conventional plasma display panel except for the width of the data electrodes 107. The width of the second data electrode 107*b* under the green fluorescent substance layer 110*b* is 1.1–1.6 times that of the first and third data electrodes 107*a* and 107*c* under the red and the blue fluorescent substance layer 110*a* and 110*c*.

In this structure, capacitance between the data electrodes 107 and the surface discharge electrode pairs are controlled by the width of the data electrodes 107. Thus, the write voltage characteristics correspond to one another regardless of the colors of the pixel and it becomes easy to drive the AC driven type plasma display panel.

Relation between the width of the electrodes 107 and the necessary write voltage for the write discharge are shown in FIG. 14. As shown in FIG. 14, if the width of the second data electrode 107 is 120–140 μm when the width of the first and the third data electrodes 107 are 90–140 μm, the necessary write voltage are within the range of ±3V regardless of the colors the pixels. The range does not bring a problem for driving the plasma display panel.

In FIG. 15, combinations of the pitches and the widths of the data electrodes are shown. As shown in FIG. 15, the widths of the data electrodes 107 depend on the pitches of the pixels. Even though the pitch has another value which is not shown in FIG. 15, the widths of the data electrodes 107 depend on the pitch and are decided by the colors of the fluorescent substance layer 110 over the data electrodes 107.

Figure 16:
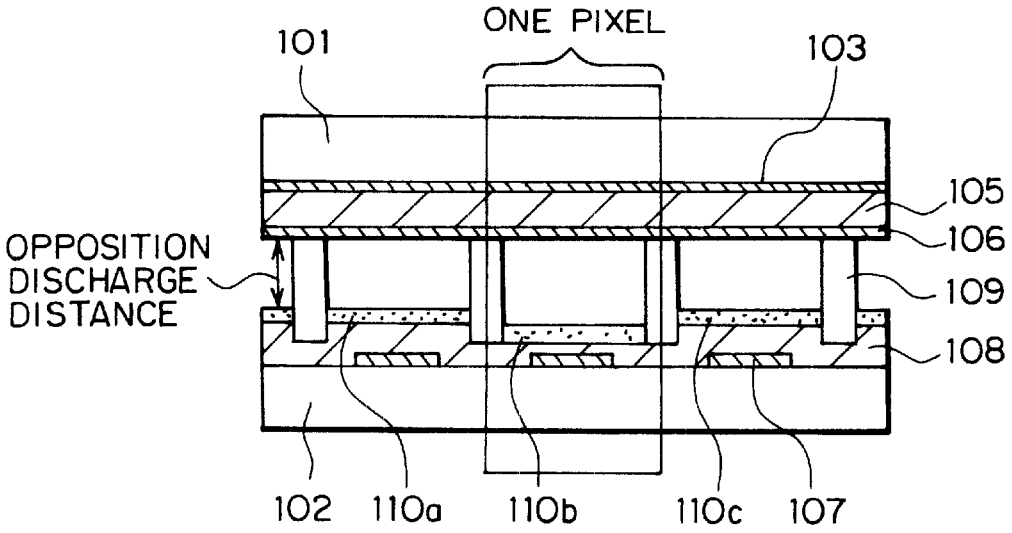
FIG. 16 is a partial sectional view of a plasma display panel according to a fourth embodiment of this invention.
Figure 17:
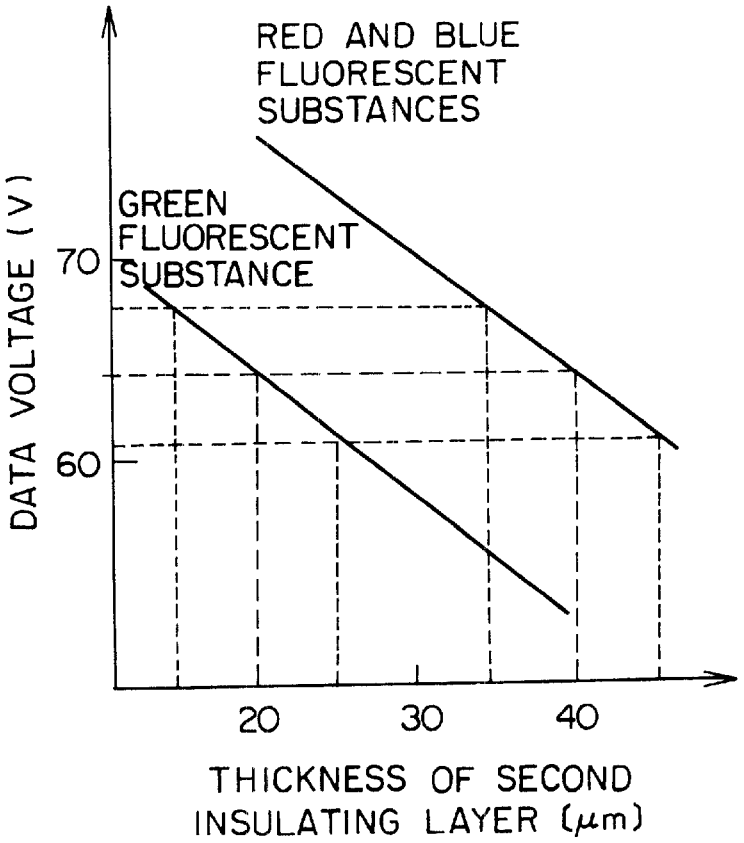
FIG. 17 is a graph showing a relation between thickness of insulating layers and data voltages for write discharges.

Referring to FIGS. 16 and 17, the description will be made about a plasma display panel according to a fourth embodiment of this invention.

In FIG. 16, opposition discharge distance of the green pixel is different form those of the red and the blue pixels. Namely, the second insulating layer 108 is divided into two areas. One is used for the red and the blue pixels and has 35–45 μm in thickness while the other is used for the green pixel and has 15–25 μm in thickness.

In each pixel, the capacitance between the data electrode 107 and the surface discharge electrode pair depends on the opposition discharge distance. Thus, if the opposition discharge distances are appropriately adjusted, the write voltage characteristics are standardized and it becomes easy to drive the plasma display panel.

As illustrated in FIG. 17, the proper write voltages are within the voltage range of ±3V, when the thickness of the second insulating layer in the green pixel is 35–45 μm and those of the second insulating layer 108 in the red and the blue pixels are 15–25 μm.

Figure 18:
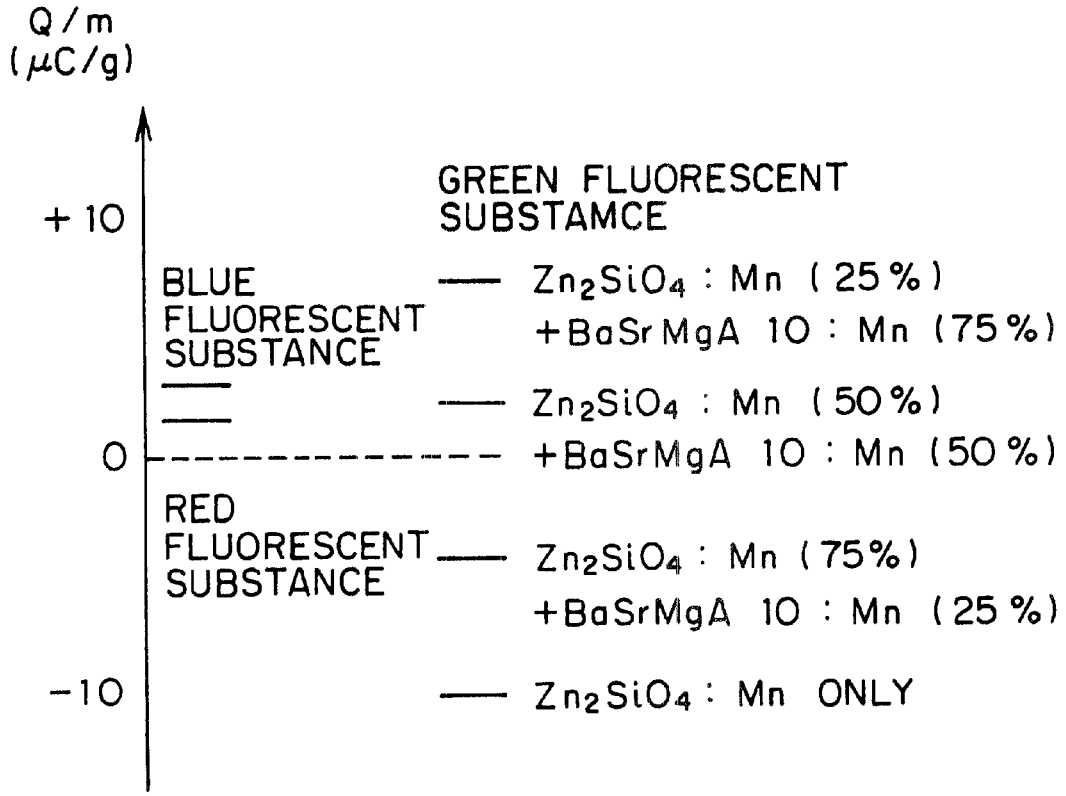
FIG. 18 is a graph showing a relation between electrification characteristics and BaSrMgAlO:Mn content.

Referring to FIG. 18, the description will be made about a plasma display panel according to a fifth embodiment of this invention. The plasma display panel has the same structure as the second embodiment shown in FIG. 11 except for the components of the green fluorescent substance layer 110*b*.

The green fluorescent substance layer 110*b* includes mixture of the $Zn_2SiO_4$:Mn and a BrSrMgAlO:Mn as the green fluorescent substance. As shown in FIG. 18, when the green fluorescent substance includes the BrSrMgAlO:Mn of 25–75 Wt % to the $Zn_2SiO_4$:Mn, the amount of the electrification in the green fluorescent substance is almost equal to those of the red and the blue fluorescent substance. In FIG. 18, the red and the blue fluorescent substances are the (Y,Gd)$BO_3$:Eu and the $BaMgAl_{10}O_{17}$, respectively. Therefore, the write voltage characteristics are standardized and it becomes easy to drive the plasma display panel.

What is claimed is:

1. A plasma display panel comprising;

red, green, and blue pixels which include data electrodes covered with an insulating layer and which have red, green, and blue voltage ranges, respectively, for write discharges caused by the use of said data electrodes, and write voltage equalizing means formed in at least one of said red, said green, and said blue pixels for approximately equalizing said voltage ranges with one another to restrict said red, green, and blue pixel voltage ranges within a predetermined voltage range said plasma display panel further comprising red, green, blue fluorescent substance layers formed on said insulating layer over said data electrodes, wherein;

said voltage equalizing means is said green fluorescent substance layer which is smaller than both of said red fluorescent substance layer and said blue fluorescent substance layer in thickness.

2. A plasma display panel as claimed in claim 1, said green fluorescent substance layer including a green fluorescent substance of $Zn_2SiO_4$ system and having a first thickness, and said red fluorescent substance layer and said blue fluorescent substance layer having a second thickness in common, wherein;

the first thickness is not smaller than 40% of the second thickness and not larger than 80% of the second thickness.

3. A plasma display panel as claimed in claim 1, said green fluorescent substance layer belonging to $Zn_2SiO_4$ system and having a first thickness, and said red fluorescent substance layer and said blue fluorescent substance layer having a second thickness in common, wherein;

the first thickness is not smaller than 6 μm and not larger than 10 μm while the second thickness is not smaller than 10 μm and not larger than 14 μm.

4. A plasma display panel comprising;

red, green, and blue pixels which include data electrodes covered with an insulating layer and which have red, green, and blue voltage ranges, respectively, for write discharges caused by the use of said data electrodes, and write voltage equalizing means formed in at least one of said red, said green, and said blue pixels for approximately equalizing said voltage ranges with one another to restrict said red, green, and blue pixel voltage ranges within a predetermined voltage range, said plasma display panel further comprising red, green, blue fluorescent substance layers formed on said insulating layer over said data electrodes, wherein;

said voltage equalizing means is said green fluorescent substance layer which includes $Zn_2SiO_4$:Mn covered by MgO.

5. A plasma display panel as claimed in claim 4, wherein an weight ratio of the MgO and the the $Zn_2SiO_4$:Mn is from 0.3 Wt % to 0.7 Wt %.

6. A plasma display panel comprising;

red, green, and blue pixels which include data electrodes covered with an insulating layer and which have red, green, and blue voltage ranges, respectively, for write discharges caused by the use of said data electrodes, and write voltage equalizing means formed in at least one of said red, said green, and said blue pixels for approximately equalizing said voltage ranges with one another to restrict said red, green, and blue pixel voltage ranges within a predetermined voltage range, said data electrodes including a first data electrode for said red pixel, a second data electrode for said green pixel, and a third data electrode for said blue pixel, wherein;

said write voltage equalizing means is said second data electrode which is larger than both said first data electrode and said third data electrode in width.

7. A plasma display panel as claimed in claim 6, said second data electrode having a first width, said first data electrode and said third data electrode being equal in width and having a second width, wherein;

the fist width is not smaller than 1.1 times of the second width and not larger than 1.6 times of the second width.

8. A plasma display panel comprising;

red, green, and blue pixels which include data electrodes covered with an insulating layer and which have red, green, and blue voltage ranges, respectively, for write discharges caused by the use of said data electrodes, and write voltage equalizing means formed in at least one of said red, said green, and said blue pixels for approximately equalizing said voltage ranges with one another to restrict said red, green, and blue pixel voltage ranges within a predetermined voltage range said insulating layer divided into a first area for said red pixel and said blue pixel and a second area for said green pixel, wherein;

said write voltage equalizing means is said second area which is smaller than said first area in thickness.

9. A plasma display panel as claimed in claim 8, said first area having a third thickness, said second area having a fourth thickness in common, wherein;

the third thickness is not smaller than 35 μm and not larger than 45 μm while the fourth thickness is not smaller than 15 μm and not larger than 25 μm.

10. A plasma display panel comprising;

red, green, and blue pixels which include data electrodes covered with an insulating layer and which have red, green, and blue voltage ranges, respectively, for write discharges caused by the use of said data electrodes, and write voltage equalizing means formed in at least one of said red, said green, and said blue pixels for approximately equalizing said voltage ranges with one another to restrict said red, green, and blue pixel voltage ranges within a predetermined voltage range, said plasma display panel further comprising red, green, blue fluorescent substance layers formed on said insulating layer over said data electrodes, wherein;

said voltage equalizing means is said green fluorescent substance layer which includes $Zn_2SiO_4$:Mn and BaSrMgAlO:Mn.

11. A plasma display panel as claimed in claim 10, wherein an weight ratio of the BaSrMgAlO:Mn and the $Zn_2SiO_4$:Mn is from 25 Wt % to 75 Wt %.

12. A plasma display panel comprising;

a front substrate with a first surface, a back substrate with a second surface which opposes said first surface at a distance, a scanning electrode formed on said first surface along a first direction, first, second, and third data electrodes formed on said second surface along a second direction perpendicular to the first direction and being used for write discharges together with said scanning electrode, an insulating layer formed on said first, said second, and said third data electrodes and exposed areas of said second surface, a red fluorescent substance layer formed on said insulating layer over said first data electrode and having a first voltage range for write discharges between said scanning electrode and said first data electrode, a green fluorescent substance layer formed on said insulating layer over said second data electrode and having a second voltage range for write discharges between said scanning electrode and said second data electrode, a blue fluorescent substance layer formed on said insulating layer over said third data electrode and having a third voltage range for write discharges between said scanning electrode and said second data electrode, write voltage equalizing means formed between said front substrate and said back substrate for approximately equalizing said first, second, and third voltage ranges to restrict said red, green, and blue pixel voltage ranges within a predetermined voltage range, wherein said voltage equalizing means is said green fluorescent substance layer which is smaller than both of said red fluorescent substance layer and said blue fluorescent substance layer in thickness.

13. A plasma display panel is claimed in claim 12, said green fluorescent substance layer including a green fluorescent substance of $Zn_2SiO_4$ system and having a first thickness, and said red fluorescent substance layer and said blue fluorescent substance layer having a second thickness in common, wherein;

the first thickness is not smaller than 40% of the second thickness and not larger than 80% of the second thickness.

14. A plasma display panel as claimed in claim 12, said green fluorescent substance layer including a fluorescent substance of $Zn_2SiO_4$ system and having a first thickness, and said red fluorescent substance layer and said blue fluorescent substance layer having a second thickness in common, wherein;

the first thickness is not smaller than 6 $\mu$m and not larger than 10 $\mu$m while the second thickness is not smaller than 10 $\mu$m and not larger than 14 $\mu$m.

15. A plasma display panel comprising;

a front substrate with a first surface, a back substrate with a second surface which opposes said first surface at a distance, a scanning electrode formed on said first surface along a first direction, first, second, and third data electrodes formed on said second surface along a second direction perpendicular to the first direction and being used for write discharges together with said scanning electrode, an insulating layer formed on said first, said second, and said third data electrodes and exposed areas of said second surface, a red fluorescent substance layer formed on said insulating layer over said first data electrode and having a first voltage range for write discharges between said scanning electrode and said first data electrode, a green fluorescent substance layer formed on said insulating layer over said second data electrode and having a second voltage range for write discharges between said scanning electrode and said second data electrode, a blue fluorescent substance layer formed on said insulating layer over said third data electrode and having a third voltage range for write discharges between said scanning electrode and said second data electrode, write voltage equalizing means formed between said front substrate and said back substrate for approximately equalizing said first, second, and third voltage ranges to restrict said red, green, and blue pixel voltage ranges within a predetermined voltage range, wherein said voltage equalizing means is said green fluorescent substance layer which includes $Zn_2SiO_4$:Mn covered by MgO.

16. A plasma display panel as claimed in claim 15, wherein an weight ratio of the MgO and the $Zn_2SiO_4$:Mn is from 0.3 Wt % to 0.7 Wt %.

17. A plasma display panel comprising;

a front substrate with a first surface, a back substrate with a second surface which opposes said first surface at a distance, a scanning electrode formed on said first surface along a first direction, first, second, and third data electrodes formed on said second surface along a second direction perpendicular to the first direction and being used for write discharges together with said scanning electrode, an insulating layer formed on said first, said second, and said third data electrodes and exposed areas of said second surface, a red fluorescent substance layer formed on said insulating layer over said first data electrode and having a first voltage range for write discharges between said scanning electrode and said first data electrode, a green fluorescent substance layer formed on said insulating layer over said second data electrode and having a second voltage range for write discharges between said scanning electrode and said second data electrode, a blue fluorescent substance layer formed on said insulating layer over said third data electrode and having a third voltage range for write discharges between said scanning electrode and said second data electrode, write voltage equalizing means formed between said front substrate and said back substrate for approximately equalizing said first, second, and third voltage ranges to restrict said red, green, and blue pixel voltage ranges within a predetermined voltage range, wherein said write voltage equalizing means is said second data electrode which is larger than both said first data electrode and said third data electrode in width.

18. A plasma display panel as claimed in claim 17, said second data electrode having a first width, said first data electrode and said third data electrode being equal in width and having a second width, wherein;

the fist width is not smaller than 1.1 times of the second width and not larger than 1.6 times of the second width.

19. A plasma display panel comprising;

a front substrate with a first surface, a back substrate with a second surface which opposes said first surface at a distance, a scanning electrode formed on said first surface along a first direction, first, second, and third data electrodes formed on said second surface along a second direction perpendicular to the first direction and being used for write discharges together with said scanning electrode, an insulating layer formed on said first, said second, and said third data electrodes and exposed areas of said second surface, a red fluorescent substance layer formed on said insulating layer over said first data electrode and having a first voltage range for write discharges between said scanning electrode and said first data electrode, a green fluorescent substance layer formed on said insulating layer over said second data electrode and having a second voltage range for write discharges between said scanning electrode and said second data electrode, a blue fluorescent substance layer formed on said insulating layer over said third data electrode and having a third voltage range for write discharges between said scanning electrode and said second data electrode, write voltage equalizing means formed between said front substrate and said back substrate for approximately equalizing said first, second, and third voltage ranges to restrict said red, green, and blue pixel voltage ranges within a predetermined voltage range, wherein said voltage equalizing means is said green fluorescent substance layer which includes $Zn_2SiO_4$:Mn and BaSrMgAlO:Mn.

20. A plasma display panel as claimed in claim 19, wherein an weight ratio of the BaSrMgAlO:Mn and the $Zn_2SiO_4$:Mn if from 25 Wt % to 75 Wt %.

* * * * *